United States Patent [19]

Takeda

[11] Patent Number: 4,570,874

[45] Date of Patent: Feb. 18, 1986

[54] TENSIONING DEVICE FOR COIL WINDING MACHINE

[75] Inventor: Shuji Takeda, Oume, Japan

[73] Assignee: TANAC Engineering Kabushiki Kaisha, Tokyo, Japan

[21] Appl. No.: 657,162

[22] Filed: Oct. 3, 1984

[30] Foreign Application Priority Data

Oct. 11, 1983 [JP] Japan ..... 58-157070[U]

[51] Int. Cl.[4] ..... B65H 59/10

[52] U.S. Cl. ..... 242/147 R; 242/155 R

[58] Field of Search ..... 242/147 R, 147 M, 155 R, 242/155 M, 156, 156.2, 45, 128, 75.3, 129.1, 129.2

[56] References Cited

U.S. PATENT DOCUMENTS 3,707,269 12/1972 Gerest ..... 242/155 R

FOREIGN PATENT DOCUMENTS 1241232 8/1960 France ..... 242/155 R

*Primary Examiner*—Stanley N. Gilreath

*Attorney, Agent, or Firm*—Spencer & Frank

[57] ABSTRACT

A tensioning device of a coil winding machine which provides back tension to a wire fed from a wire supply source to a coil winding position through a main tension pulley and a back tension lever which is urged in the back tension applying direction by a spring and is swingably supported. The tensioning device comprises a first back tension spring having one end connected with the back tension lever, a second back tension spring having one end connected to a fixed position of the device, the spring constant of the second back tension spring being smaller than that of the first back tension spring, and means for connecting the first and second back tension springs. A control member is further provided, which fixes the connecting means so that in a first operating mode only the first back tension spring acts on the back tension lever and in a second operating mode the first and second back tension springs operate in series to control the back tension lever.

3 Claims, 5 Drawing Figures

TENSIONING DEVICE FOR COIL WINDING MACHINE

BACKGROUND OF INVENTION

The present invention relates to a tensioning device for a coil winding machine, which gives tension to a wire being wound.

A coil winding machine is used to wind a wire supplied from a supply bobbin around a coil bobbin, and it is usual that an adequate tensioning device is provided to give necessary tension to the wire being fed.

FIG. 1 shows a general configuration of such the conventional tensioning device for a coil winding machine. In the figure, a tensioning device 10 basically consists of a main tension pulley 14 to which a braking torque is applied, a back tension lever 15 which absorbs any fluctuation in the tension of the wire, and a pulley 17 mounted at a swinging end of the back tension lever 15, so as to give necessary tension to the wire drawn through the main tension pulley 14 and the pulley 17.

The main tension pulley 14 provides a constant breaking force to the wire by applying a magnetic force on a magnetic disc rotated integrally with the main tension pulley 14. In some devices, regulation of the braking torque is provided by regulation of the pressure of a band brake.

The wire 3, after passing around the main tension pulley 14, passes an idle pulley 18, the pulley 17 provided at the swinging end of the back tension lever 15, an idle pulley 4. It is a nozzle 5, and then wound by a bobbin 2 which is rotated with high speed by the coil winding machine 1. The nozzle 5 is movable by the coil winding machine 1 to right and left of the figure.

The back tension lever 15 is swingable about a supporting point 11, and with the aid of a tension spring 12 is given a rotating force in the clockwise direction thereby providing for absorption of fluctuation in the back tension and keeping a constant tension at the coil winding position.

In many of the then developed coil winding machines, a device is further provided for automatically binding a wire on a terminal pin mounted on the bobbin 2 before the ordinary coil winding operation. In these cases, the nozzle 5 is forced to make a complicated movement, and therefore if the above mentioned constant tension is continually applied to the wire, the coating of the wire strikes hard against the inlet (it being also an outlet) of the nozzle 5 and is broken away. It often occurs that after binding of the wire, the next coil winding begins in a continuous manner, and in such case there arises the danger of a short circuit at the point of breakaway of the coating.

An object of this invention is therefore to provide a tensioning device for a coil winding machine which overcomes the above-mentioned drawbacks of the conventional devices.

SUMMARY OF INVENTION

The tensioning device of a coil winding machine according to this invention provides a back tension to a wire fed from a wire supply source to a coil winding position through a main tension pulley and a back tension lever which is urged in the back tension applying direction by a spring and is swingably supported. The tensioning device thus constructed comprises a first back tension spring having one end connected with the back tension lever, a second back tension spring having one end connected to a fixed position of the device, the spring constant of the second back tension spring being smaller than that of the first back tension spring, and means for connecting the first and second back tension springs. A control member is further provided, which fixes the connecting means so that in that state only the first back tension spring acts on the back tension lever and which release the fixing by a signal applied from outside, so as to let the first and second back tension springs operate in series to the back tension lever.

DESCRIPTION OF A PREFERRED EMBODIMENT

Figure 1:
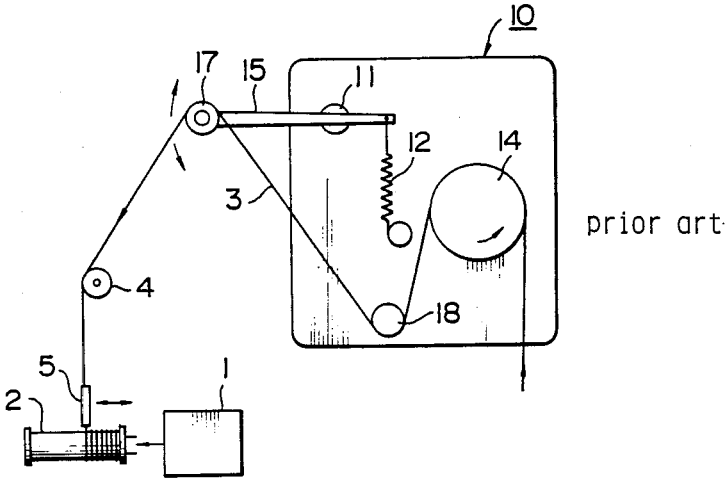
FIG. 1 is a schematic view showing a conventional tensioning device of a coil winding machine.
Figure 2A:
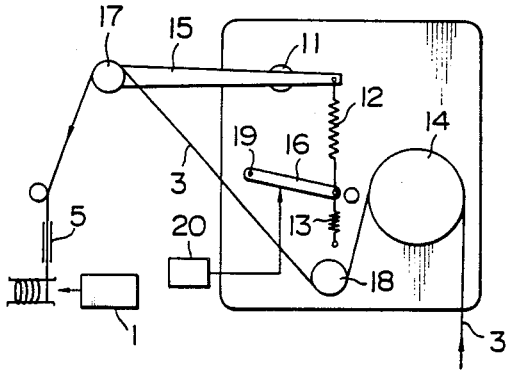
FIGS. 2(A) and 2(B) are schematic views for explaining the principle of the operation of the tensioning device of a coil winding machine according to the present invention.
Figure 2B:
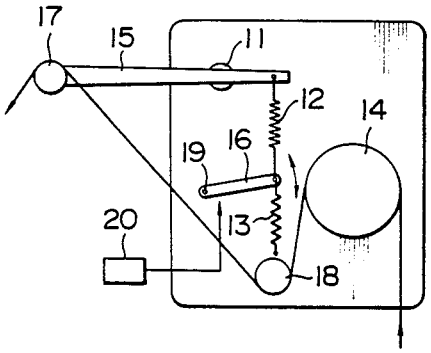

FIG. 2(A) shows the ordinary coil winding state and FIG. 2(B) shows the state wherein the back tension has been reduced. In the figures, the same numerals as those used in FIG. 1 are used for indicating the identical or similar members in the figure.

One end of a first back tension spring 12 is connected to a back tension lever 15, while the other end thereof is connected to a free end of a swing lever 16, which connects the first back tension spring 12 and a second back tension spring 13. The lever 16 is swingable around an axle 19. One end of the second back tension spring 13 is fixed to a fixing position of a housing, while the other end of the spring 13 is connected to a free end of the swing lever 16. The spring constant Kb of the second back tension spring 13 is made sufficiently smaller than that of the first back tension spring 12, Ka.

Means 20 fixes the swing lever 16 in a first operating mode or position shown in FIG. 2(A) and releases it to a second operating mode or position when necessary. When the swing lever 16 is fixed at the position shown in FIG. 2(A), or in other words in the ordinary coil winding state, only the first back tension spring 12 acts on the back tension lever 15. On the other hand, when the swing lever 16 is released by the fixing means 20, both the first and second back tension springs 12 and 13 act on the back tension lever 15 since they are then connected in series. The spring constant in this state is given by the following equation:

$$[(1/Ka)+(1/Kb)]\approx Kb, \quad (1)$$

and thus the back tension becomes extremely small.

Figure 4:
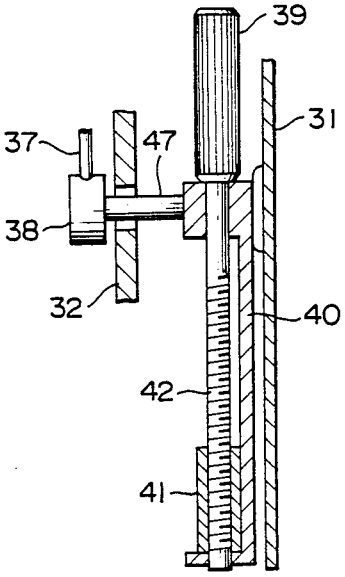
FIG. 4 is a cross-sectional view of a tension controlling mechanism according to the present invention.
Figure 3:
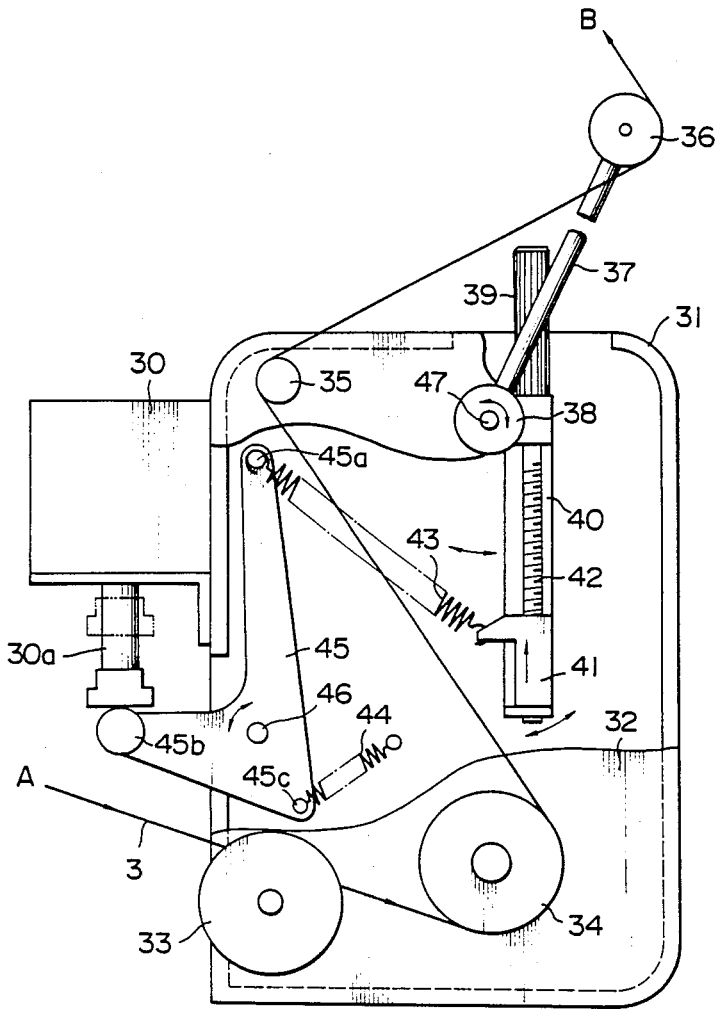
FIG. 3 is a front view of the tensioning device of a coil winding machine according to the present invention.

FIG. 3 is a front view of the tensioning device of a coil winding machine according to the present invention and FIG. 4 is a cross sectional view of a part thereof.

A wire 3 supplied, in the direction indicated by A in the figure, from a wire supply source is at first held softly by a wire pad 33 provided on a cover plate 32 of the housing 31 of the tensioning device. The wire pad 33 comprises two felt sheets which are urged against the wire. The wire which passes the pad 33 is wound for one and a half turns or so on a main tension pulley 34 and then passes a pulley 35 and another pulley 36 mounted at one end of a back tension lever 37, thereby being drawn towards the coil winding machine. A disc (not shown) made of magnetic material is attached to an axle of the main tension pulley 34. The disc faces a multipolar permanent magnet and is therefore acted on by a force in the direction which impedes rotation of the pulley 34. A constant tension acts on the wire 3 which is drawn against this impeding force.

A base portion 38 of the back tension lever 37 is fixed to an angle 47 which is mounted integrally with a rotating stand 40. The rotating stand 40 is on the other hand rotatably supported on the bottom plate of the tension device housing 31 at the underside of the axle 47. Thus, the rotating stand 40 and the back tension lever 37 are rotatable integrally with each other. To the rotating stand 40 is rotatably supported an adjusting screw 42, and this adjusting screw 42 is combined with a moving piece 41 having a female screw. By rotating an adjusting knob 39 integrally provided with the adjusting screw 42, the moving piece 41 moves up and down as shown in FIG. 3.

As mentioned above, the pulley 36, the back tension lever 37, the back tension lever base 47, the rotation stand 40, adjusting knob 39, moving piece 41 and the adjusting screw 42 rotate together, and so these will hereinafter be called the back tension lever assembly. In this assembly, the moving piece 41 is used to change the operational point of the first back tension spring 43 against the back tension lever assembly. A V-shaped swing lever 45, which is a connecting means, is supported on the bottom plate of the tensioning device housing 31 rotatably about an axle 46. Between a pin 45*a* mounted at one end of the swing lever 45 and the moving piece 41 of the back tension lever assembly there is passed the first back tension spring 43. Similarly, between a pin 45*c* mounted on the swing lever 45 and a pin mounted on the bottom face of the tension device housing 31, there is passed a second back tension spring 44.

At one side of the tension device housing 31, there is provided an air cylinder 30 to fix the position of the swing lever 45. When the air cylinder 30 is urged, an air cylinder rod 30*a* is pushed out to the position shown by a solid line in the figure, to push the other pin 45*b* of the swing lever 45. The swing lever 45 accordingly is pressed against the tensioning device housing 31 and fixed there. In this state, only the first back tension spring 43 acts on the back tension lever assembly.

Once the urging of the air cylinder 30 is removed, the air cylinder rod 30*a* moves to the position shown by the broken line, and accordingly the swing lever 45 is released and becomes rotatable about the axle 46. Accordingly, the first back tension spring 43 and the second back tension spring 44 act in series on the swing lever 45. As described before, the second back tension spring 44 is weaker than the first back tension spring 43 and therefore the back tension is reduced. Thus, the binding operation other than the ordinary coil winding becomes very easy.

As explained above in detail, the tensioning device for a coil winding machine according to the present invention provides a first back tension spring and a second back tension spring whose spring constant is weaker than that of the first back tension spring, and enables the selectional usage of these springs, during ordinary coil winding and other operations. The drawbacks mentioned above, i.e., the breakaway of the coating of the wire at the time of the initial binding operation can be avoided completely.

What is claimed is:

1. A tensioning device for a coil winding machine wherein a wire is fed from a wire supply source to a coil winding station, comprising a housing;

a main tension pulley rotatably supported by said housing;

a back tension lever swingably supported by said housing for applying a back tension to said wire, said wire being guided by said main tension pulley and back tension lever as said wire is fed from said wire supply source to said coil winding station;

a first back tension spring having one end connected to said back tension lever;

a second back tension spring having one end connected to said housing;

connecting means pivotably mounted on said housing, said connecting means coupling together the other ends of said first and second back tension springs; and a control means coupled to said connecting means for selectively switching said connecting means between a first operating mode wherein the back tension applied by said back tension lever to said wire is determined by said first back tension spring, and a second operating mode wherein the back tension applied by said back tension lever to said wire is determined by said first and second back tension springs acting in series, the back tension applied to said wire when said connecting means is operating in said second mode being less than that applied to said wire when said connecting means is operating in said first mode.

2. A tensioning device for a coil winding machine according to claim 1, wherein the connecting means is a swing lever.

3. A tensioning device for a coil winding machine according to claim 2, wherein said control means comprises an air cylinder for moving said swing lever between said first operating mode in which said swing lever is fixed in position and said second operating mode in which said swing lever is pivotable.

* * * * *